US009453663B2

(12) United States Patent
Luo et al.

(10) Patent No.: US 9,453,663 B2
(45) Date of Patent: Sep. 27, 2016

(54) HEAT-ACTUATED DOUBLE-ACTING TRAVELING-WAVE THERMOACOUSTIC REFRIGERATION SYSTEM

(71) Applicant: LIHAN CRYOGENICS CO., LTD., Shenzhen (CN)

(72) Inventors: Ercang Luo, Shenzhen (CN); Jianying Hu, Shenzhen (CN); Zhanghua Wu, Shenzhen (CN); Guoyao Yu, Shenzhen (CN); Haibing Li, Shenzhen (CN)

(73) Assignee: LIHAN CRYOGENICS CO., LTD., Guangdong (CN)

( * ) Notice: Subject to any disclaimer, the term of this patent is extended or adjusted under 35 U.S.C. 154(b) by 310 days.

(21) Appl. No.: 14/192,814

(22) Filed: Feb. 27, 2014

(65) Prior Publication Data

US 2014/0174102 A1 Jun. 26, 2014

Related U.S. Application Data

(63) Continuation of application No. PCT/CN2012/073385, filed on Mar. 31, 2012.

(30) Foreign Application Priority Data

Apr. 1, 2011 (CN) ..... 2011 1 0082320
Apr. 25, 2011 (CN) ..... 2011 1 0103954

(51) Int. Cl.
*F25B 9/00* (2006.01)
*F25B 9/14* (2006.01)

(52) U.S. Cl.
CPC ..... *F25B 9/145* (2013.01); *F25B 2309/1403* (2013.01); *F25B 2309/1409* (2013.01); *F25B 2309/1426* (2013.01)

(58) Field of Classification Search
CPC ..... F25B 2309/1426; F25B 2309/1403; F25B 2309/1409; F25B 9/145; F25B 2309/1402; F25B 9/00; F25B 9/002; F25B 9/006; F25B 9/10; F25B 9/14
USPC ..... 62/6
See application file for complete search history.

(56) References Cited

U.S. PATENT DOCUMENTS

2008/0110180 A1 5/2008 Watanabe et al. ..... 62/6
2011/0265505 A1* 11/2011 Schwartz ..... F25B 9/145 62/215

FOREIGN PATENT DOCUMENTS

CN 100366991 C 2/2008
CN 100545449 C 9/2009
CN 101706169 A 5/2010
GB 42 20 840 A1 1/1993

OTHER PUBLICATIONS

International Search Report of corresponding International Application No. PCT/CN2012/073385, dated Jun. 14, 2012.

(Continued)

*Primary Examiner* — Len Tran
*Assistant Examiner* — Ana Vazquez
(74) *Attorney, Agent, or Firm* — J.C. Patents

(57) ABSTRACT

The present invention discloses a heat-actuated double-acting traveling-wave thermoacoustic refrigeration system, comprising at least three elementary units; each elementary unit comprises a thermoacoustic engine, a thermoacoustic refrigerator, and a resonance device; the thermoacoustic engine and the thermoacoustic refrigerator comprise a main heat exchanger, a heat regenerator, a non-normal-temperature heat exchanger, a thermal buffer tube, and an auxiliary heat exchanger connected in sequence; the resonance device comprises a sealed housing, a moving part is provided in the housing for a reciprocating motion; the moving part separates the housing into at least two chambers; the main heat exchanger and auxiliary heat exchanger of each thermoacoustic engine and thermoacoustic refrigerator respectively connects to chambers of different housing, forming dual-loop structure of gas medium flow. In heating the non-normal-temperature heat exchanger of the thermoacoustic engine to produce acoustic power, thermoacoustic energy conversion is induced inside the thermoacoustic engine and the thermoacoustic refrigerator.

10 Claims, 8 Drawing Sheets

(56) References Cited

OTHER PUBLICATIONS

Chinese First Examination Report of corresponding China Application No. 201110103954.1, dated Aug. 5, 2013.

The extended European Search Report of corresponding European patent application No. 12 76 3287 and corresponding international PCT application No. PCT/CN2012/073385, dated Feb. 16, 2016.

* cited by examiner

HEAT-ACTUATED DOUBLE-ACTING TRAVELING-WAVE THERMOACOUSTIC REFRIGERATION SYSTEM

CROSS-REFERENCE TO RELATED APPLICATIONS

This application is a continuation of International Patent Application No. PCT/CN2012/073385, filed on Mar. 31, 2012, which claims priority to Chinese Patent Applications No. 201110082320.2 and No. 201110103954.1, filed on Apr. 1, 2011, and Apr. 25, 2011 respectively, all of which are hereby incorporated by reference in their entireties.

TECHNICAL FIELD

The present invention relates to energy power and low-temperature cooling technology, in particular, to a heat-actuated double-acting traveling-wave thermoacoustic cooling system driving by thermoacoustic engine.

BACKGROUND

When propagating in a gas, acoustic waves will enable propagation medium gas to generate fluctuations of pressure, displacement, and temperature. When interacting with a fixed boundary, the gas can induce exchanges between acoustic energy and heat energy, which is thermoacoustic effect.

A thermoacoustic system is an energy conversion system designed using the thermoacoustic effect principle, which may convert heat energy into acoustic energy, or convert acoustic energy into heat energy. Thermoacoustic systems can be divided into two kinds: thermoacoustic engines and a thermoacoustic refrigerators, wherein thermoacoustic engines mainly includes traveling-wave thermoacoustic engines and Stirling engines, and thermoacoustic refrigerators mainly include traveling-wave thermoacoustic refrigerators, pulse tube refrigerators and Stirling refrigerators.

In the above thermoacoustic systems, the thermoacoustic engines and refrigerators are using air or inert gases, such as helium or nitrogen, as a working medium. They have advantages in high efficiency, safety and long service life, thus having attracted widespread public attention. Hitherto employing a thermoacoustic engine in power generation and employing a thermoacoustic refrigerator in low-temperature refrigeration have already been successful.

Refer to FIG. 1 being a schematic view of an existing traveling-wave thermoacoustic refrigeration system.

As it is shown in FIG. 1, the traveling-wave thermoacoustic refrigeration system includes three elementary units, where each elementary unit includes a linear motor 1*a* and a thermoacoustic conversion device 2*a*.

The linear motor 1*a* includes a cylinder 11*a*, a piston 12*a*, a piston rod 13*a*, a motor housing 14*a*, a stator 15*a*, a mover 16*a*, and an Oxford spring 17*a*.

The stator 15*a* and the inner wall of the motor housing 14*a* are fixedly connected; the mover 16*a* and the stator 15*a* are of clearance fit; the piston rod 13*a* and the mover 16*a* are fixedly connected; the piston rod 13*a* and the Oxford spring 17*a* are fixedly connected; when the linear motor 1*a* is working, the mover 16*a* drives the piston 12*a* performing a linear reciprocating motion within the cylinder 11*a* through the piston rod 13*a*.

The thermoacoustic conversion device 2*a* includes a main heat exchanger 21*a*, a heat regenerator 22*a*, and a non-normal-temperature heat exchanger 23*a* connected in sequence. The main heat exchanger 21*a* is connected to a cylinder cavity of a linear motor 1*a*, i.e., a compression chamber 18*a*; the non-normal-temperature heat exchanger 23*a* is connected to a cylinder cavity of another linear motor 1*a*, i.e., an expansion chamber 19*a*; each thermoacoustic conversion device 2*a* is coupled to each linear motor 1*a* in sequence, thus, the thermoacoustic refrigerator constitutes a loop of medium flow.

When the traveling-wave thermoacoustic refrigeration system is working, electric power is supplied to the linear motor 1*a*. The mover 16*a* drives the piston 12*a* performing a linear reciprocating motion within the cylinder 11*a*, the gas medium volume within the compression chamber 18*a* has changed, generates acoustic energy and enters into the main heat exchanger 21*a*, passes through the heat regenerator 22*a*, within which most of the acoustic energy has been consumed, producing refrigeration effect so as to lower the temperature of the non-normal-temperature heat exchanger. The remaining acoustic energy once again comes out from the non-normal-temperature heat exchanger 23*a*, feeds back to an expansion chamber 19*a* of another linear motor 1*a*, and is transferred to a piston 12*a* of the second linear motor 1*a*.

During the course of study for the present invention, the inventor has figured out technical limitations as follows: the traveling-wave thermoacoustic refrigeration system converts the electric power into acoustic power through the linear motor 1*a*, and realizes thermoacoustic energy conversion through the thermoacoustic conversion device 2*a*, producing refrigeration effect. Nevertheless, in an area with absence of electricity and abundant thermal energy, e.g., in an area where solar power is relatively adequate whereas electricity supply is inconvenient and electricity is scarce, the application of the existing travel-wave thermoacoustic refrigeration system will be largely restricted, even cannot be applied.

In addition, in the work of the traveling-wave thermoacoustic refrigeration system, since the temperature of the gas medium coming out from the non-normal-temperature heat exchanger 23*a* connected to the heat regenerator 22*a* is relatively lower, and the temperature of the gas medium fed back to the expansion chamber 19*a* is relatively lower, under the condition that the cylinder 11*a* and the piston 12*a* works in a relatively low temperature, there is high demand for the process and manufacture of the piston 12*a*. Therefore, the manufacturing cost of the traveling-wave thermoacoustic refrigeration system will be increased, and the service life of the linear motor 1*a* will be reduced.

SUMMARY

Embodiments according to the present invention provide a heat-actuated double-acting traveling-wave thermoacoustic refrigeration system so as to fix defects in the prior art, use heat source as an actuation to secure refrigeration effect, improve the scope of application of the traveling-wave thermoacoustic refrigeration system, reduce manufacturing costs, and improve the service life.

The present invention provides a double-acting thermoacoustic-actuated traveling-wave refrigeration system, including: at least three elementary units, wherein each elementary unit includes a thermoacoustic engine, a thermoacoustic refrigerator, and a resonance device; the thermoacoustic engine and the thermoacoustic refrigerator respectively include a main heat exchanger, a heat regenerator, a non-normal-temperature heat exchanger, a thermal buffer tube, and an auxiliary heat exchanger connected in sequence;

the resonance device includes a sealed housing in which it is equipped with a moving part being in a reciprocating motion, wherein the moving part separates the housing into at least two chambers; and the main heat exchanger and auxiliary heat exchanger of each thermoacoustic engine and thermoacoustic refrigerator are respectively connected to chambers of different housing, forming a dual-loop structure of gas medium flow.

The present invention also provides a heat-actuated double-acting traveling-wave thermoacoustic refrigeration system, including: at least three elementary units, wherein each elementary unit includes a thermoacoustic engine, a thermoacoustic refrigerator, and a resonance device; the thermoacoustic engine and the thermoacoustic refrigerator respectively include a main heat exchanger, a heat regenerator, a non-normal-temperature heat exchanger, a thermal buffer tube, and an auxiliary heat exchange connected in sequence;

the resonance device includes a sealed housing in which it is equipped with a moving part being in a reciprocating motion, wherein the moving part separates the housing into at least two chambers; and in each essential unit, the main heat exchanger or auxiliary heat exchanger of the thermoacoustic engine is connected to the auxiliary heat exchanger or main heat exchanger of the thermoacoustic refrigerator; in each elementary unit, the other two ends of the thermoacoustic engine and the thermoacoustic refrigerator are respectively connected to chambers of different housing, forming a single loop structure of gas medium flow.

The present invention discloses a heat-actuated double-acting traveling-wave thermoacoustic refrigeration system, including at least three elementary units, wherein each elementary unit includes a thermoacoustic engine, a thermoacoustic refrigerator, and a resonance device; the thermoacoustic engine and the thermoacoustic refrigerator include a main heat exchanger, a heat regenerator, a non-normal-temperature heat exchanger, a thermal buffer tube, and an auxiliary heat exchanger connected in sequence; the thermoacoustic refrigerator is driven by the thermoacoustic engine, where acoustic power is produced by heating the non-normal-temperature heat exchanger of the thermoacoustic engine t, thermoacoustic energy conversion is induced inside the thermoacoustic engine and the thermoacoustic refrigerator. Therefore, it is possible to produce refrigeration effect with heat input solely. In contrast to the prior art, the heat-actuated traveling-wave thermoacoustic refrigeration system provided by the present invention can be applied in areas with abundant thermal energy and absence of electricity, thus being capable of a more extensive range of application.

In addition, because the thermoacoustic engine and the thermoacoustic refrigerator have the thermal buffer tube and the auxiliary heat exchanger, the temperature of a gas medium fed back to another resonance device is close to room temperature. Therefore, it can guarantee the resonance device's working at room temperature, thus reducing the manufacturing costs of the resonance device and improving the service life.

Figure 1:
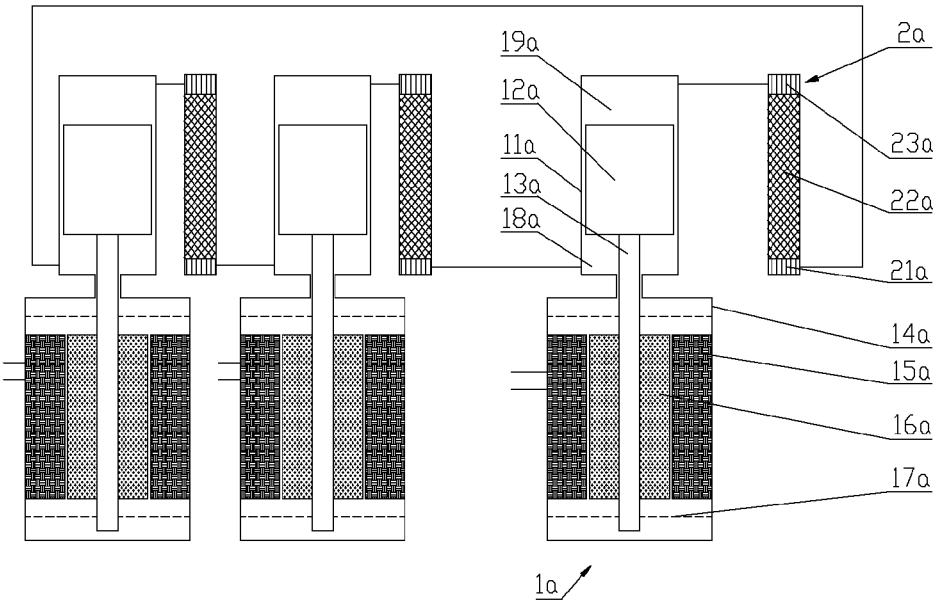
FIG. 1 is a schematic view of an existing travel-wave thermoacoustic refrigeration system.

Reference signs:

| | | |
|---|---|---|
| 1 Thermoacoustic engine | 11 First main heat exchanger | 12 First heat regenerator |
| 13 First non-normal-temperature heat exchanger | | 14 First thermal buffer tube |
| 15 First auxiliary heat exchanger | 2 Thermoacoustic refrigerator | 21 Second main heat exchanger |
| 22 Second heat regenerator | 23 Second non-normal-temperature heat exchanger | |
| 24 Second thermal buffer tube | 25 Second auxiliary heat exchanger | 3 Resonance device |
| 31 Cylinder | 32 Piston | 33 Expansion chamber |
| 331 First expansion chamber | 332 Second expansion chamber | 34 compassion chamber |
| 35 U-shaped tube | 36 U-shaped liquid column | 37 Buffer chamber |

DESCRIPTION OF EMBODIMENTS

The present invention provides a heat-actuated double-acting traveling-wave thermoacoustic refrigeration system, including: at least three elementary units, wherein each elementary unit includes a thermoacoustic engine, a thermoacoustic refrigerator, and a resonance device; the thermoacoustic engine and the thermoacoustic refrigerator respectively include a main heat exchanger, a heat regenerator, a non-normal-temperature heat exchanger, a thermal buffer tube, and an auxiliary heat exchanger connected in sequence; the resonance device includes a sealed housing in which it is equipped with a moving part being in a reciprocating motion, wherein the moving part separates the housing into at least two chambers; and the main heat exchanger and auxiliary heat exchanger of each thermoacoustic engine and thermoacoustic refrigerator are respectively connected to chambers of different housing, forming a dual-loop structure of gas medium flow.

The present invention also provides a heat-actuated double-acting traveling-wave thermoacoustic refrigeration system, including: at least three elementary units, wherein each elementary unit includes a thermoacoustic engine, a thermoacoustic refrigerator, and a resonance device; the thermoacoustic engine and the thermoacoustic refrigerator respectively include a main heat exchanger, a heat regenerator, a non-normal-temperature heat exchanger, a heat buffer tube, and an auxiliary heat exchanger connected in sequence; the resonance device includes a sealed housing in which it is equipped with a moving part being in a reciprocating motion, wherein the moving part separates the housing into at least two chambers; and in each elementary unit, the main heat exchanger or auxiliary heat exchanger of the thermoacoustic engine is connected to the auxiliary heat exchanger or main heat exchanger of the thermoacoustic refrigerator; in each elementary unit, the other two ends of the thermoacoustic engine and the thermoacoustic refrigerator are respectively connected to chambers of difference housing, forming a single loop structure of gas medium flow.

In the heat-actuated double-acting traveling-wave thermoacoustic refrigeration system according to the present invention, the thermoacoustic refrigerator is driven by the thermoacoustic engine, where acoustic power is produced by heating the non-normal-temperature heat exchanger of the thermoacoustic engine, thermoacoustic energy conversion is induced inside the thermoacoustic engine and the thermoacoustic refrigerator. Therefore, it is possible to produce refrigeration effect with heat input solely. In contrast to the prior art, the heat-actuated traveling-wave thermoacoustic refrigeration system provided by the present invention can be applied in areas with abundant thermal energy and absence of electricity, thus being capable of a more extensive range of application.

In addition, because the thermoacoustic engine and the thermoacoustic refrigerator have the heat buffer tube and the auxiliary heat exchanger, the temperature of a gas medium fed back to another resonance device is close to room temperature. Therefore, it can guarantee the resonance device's working at room temperature, thus reducing the manufacturing costs of the resonance device and improving the service life.

Based upon the above technical solutions, design modes of the resonance device can be multiple; the resonance device has two or more chambers. There are numerous connection modes between the main heat exchanger and the auxiliary heat exchange in the thermoacoustic engine and the thermoacoustic refrigerator and the chambers of the resonance device, which may form many loop structures with different paths. For example:

Each resonance device can include two chambers, which are respectively a compression chamber and an expansion chamber in view of the different heat exchangers to which they are connected.

Means of realizing two chambers can be: the resonance device employs a cylindrical piston and a cylindrical cylinder, where the two chambers are formed on both sides of the piston. Optionally, the shapes of the cylinder and piston are staircase structures matching each other; the two chambers are formed at different stairs on the same side of the piston. Optionally, the resonance device is a U-shaped tube structure inside which there is a U-shaped liquid column; the two chambers are formed at both ends of the U-shaped liquid column.

Means of realizing a plurality of chambers can be: the resonance device employs a piston and a cylinder with matching shapes, where the cylinder and the piston are formed with staircase structures. The chambers are formed at each stair on the staircase side of the piston and at a flat side of the piston, where the unconnected chambers function as gas springs in adjusting the working frequency of the system.

Different loop structures formed by the connection modes of the chambers and the heat exchangers are relevant to the working phase of the gas medium. The loop structures coupled with appropriate numbers of elementary units can improve working efficiency.

For example, it is possible to set the working surfaces of the pistons in each chamber as parallel and in opposite directions, where the numbers of the corresponding elementary units are three or four. Optionally, the working surfaces of the pistons in each chamber are parallel and in the same direction, where the numbers of the corresponding elementary units are four, five, or six.

The combination of various design elements, such as numbers and positions of the chambers, the loop structures and the numbers of elementary units, can obtain different embodiments. In an attempt to enable the person skilled in the art to better understand the technical solutions of the present invention, further elaboration of the present invention will be set forth as follows in conjunction with figures and embodiments.

Figure 2:
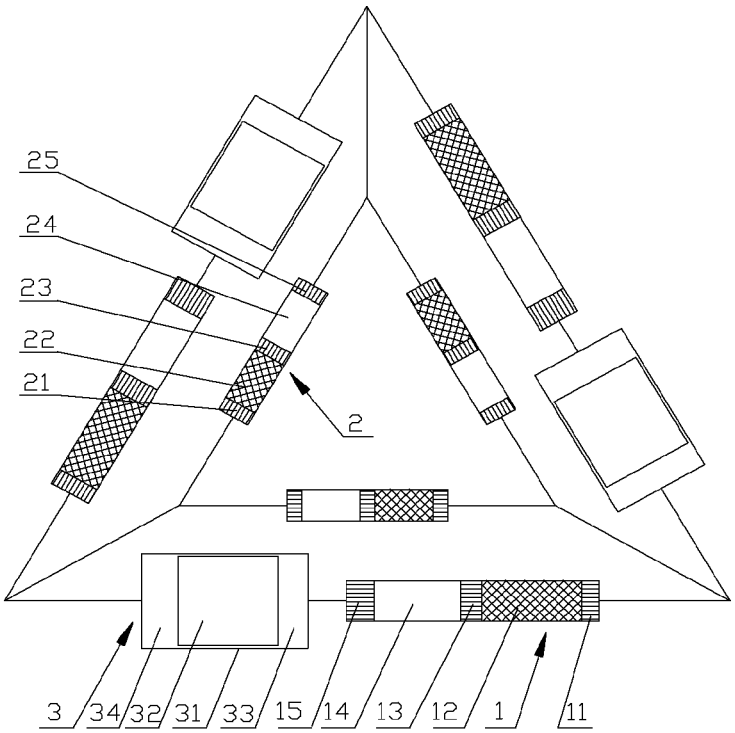
FIG. 2 is a schematic view of a heat-actuated double-acting traveling-wave thermoacoustic refrigeration system according to a first embodiment of the present invention.

Refer to FIG. 2, being a schematic view of a heat-actuated double-acting traveling-wave thermoacoustic refrigeration system according to a first embodiment of the present invention.

According to the first embodiment of the present invention, the heat-actuated double-acting traveling-wave thermoacoustic refrigeration system includes three elementary units. FIG. 2 only indicates reference signs of each component in the elementary unit close to the bottom of the figure. Because components of other two elementary units are completely the same as that of this elementary unit, there is no indication for other same components in FIG. 2 in simplifying the figure.

Each elementary unit includes a thermoacoustic engine 1, a thermoacoustic refrigerator 2 and a resonance device 3. In each elementary unit, the thermoacoustic engine 1 includes a first main heat exchanger 11, a first heat regenerator 12, a first non-normal-temperature heat exchanger 13, a first heat buffer tube 14, and a first auxiliary heat exchanger 15 connected in sequence.

The thermoacoustic refrigerator 2 includes a second main heat exchanger 21, a second heat regenerator 22, a second non-normal-temperature heat exchanger 23, a second heat buffer tube 24 and a second auxiliary heat exchanger 25 connected in sequence.

The resonance device 3 includes a cylinder 31, in which a piston 32 is equipped in a reciprocating motion. The piston 32 and the cylinder 31 are minimal clearance fitted, where the coordination clearance can be 0.01-0.1 mm. In the present embodiment, the number of the cylinder 31 and the piston 32 of each resonance device 3 is one. Preferably, the working surfaces of the piston 32 in each cylinder 31 are parallel and in opposite directions, where the working surface of the piston 32 refers to the surface capable of directly acting with the gas medium inside the cylinder 31 as the piston 32 is in motion. The piston 32 divides the cylinder 31 into an expansion chamber 33 and a compression chamber 34.

In particular, according to the embodiment, in each elementary unit, the first auxiliary heat exchanger 15 of the thermoacoustic engine 1 connects to the expansion chamber 33 of the resonance device 3, and the second auxiliary heat exchanger 25 of the thermoacoustic refrigerator 2 and the compression chamber 34 of the resonance device 3 together connect to the second main heat exchanger 21 of the thermoacoustic refrigerator 2 in another elementary unit. It is shown that an outer-loop structure formed by the thermoacoustic engine 1 and the resonance device 3 and an inner-loop structure formed by the thermoacoustic refrigerator 2, thereby forming a dual-loop structure for acoustic power transmission.

It should be noted firstly that, as the phase difference of volume flow at both ends of the thermoacoustic engine 1 and the thermoacoustic refrigerator 2 is within a range of 90 degrees to 150 degrees, the thermoacoustic conversion efficiency of the thermoacoustic engine 1 and the thermoacoustic refrigerator 2 is relatively high.

The transmission path of the acoustic power for the heat-actuated double-acting traveling-wave thermoacoustic refrigeration system according to the embodiment will be specifically described hereinafter:

Because the phase difference between the volume flow at one end of the first main heat exchanger 11 of the thermoacoustic engine 1 and the volume flow at one end of the first auxiliary heat exchanger 15 of the thermoacoustic engine 1 is 120 degrees, the thermoacoustic engine 1 can obtain relatively higher thermoacoustic conversion efficiency.

Meanwhile, because the phase difference is 120 degrees, in the outer-loop formed by the thermoacoustic engine 1 and the resonance device 3, the acoustic power in the thermoacoustic engine 1 flows from the first heat regenerator 12 to the first thermal buffer tube 14. Equally, in the inner loop formed by the thermoacoustic refrigerator 2, volume flow at one end of the second main heat exchanger 21 of the thermoacoustic refrigerator 2 precedes volume flow at one end of the second auxiliary heat exchanger 25, therefore, the acoustic power in the thermoacoustic refrigerator 2 also flows from the second heat regenerator 22 to the second thermal buffer tube 24.

The working process for the heat-actuated double-acting traveling-wave thermoacoustic refrigeration system according to the embodiment will be specifically described hereinafter:

First, heat the first non-normal-temperature heat exchanger 13 of the thermoacoustic engine 1. Once the temperature of the first non-normal-temperature heat exchanger 13 reaches a threshold, the acoustic power enters into the first heat regenerator 12 from the first main heat exchanger 11. The acoustic power has been enlarged after the acoustic wave absorbs thermal power, and it enters into the expansion chamber 33 of the resonance device 3 through the first thermal buffer tube 14 and the first auxiliary heat exchanger 15, thereby propelling the piston 32 to move. The piston 32 transfers to the compression chamber 34 the acoustic power, which is then divided into two portions. One portion of the acoustic power enters into the first main heat exchanger 11 of the thermoacoustic engine 1 in another elementary unit, whereas the other portion of the acoustic power enters into the second main heat exchanger 21 of the thermoacoustic refrigerator 2 in another elementary unit. The majority of the acoustic power entering into the thermoacoustic refrigerator 2 has been consumed inside the second heat regenerator 22, producing refrigeration effect at the same time, which lowers the temperature of the second non-normal-temperature heat exchanger 23 of the thermoacoustic refrigerator 2. The remaining acoustic power passes through the second thermal buffer tube 24 and the second auxiliary heat exchanger 25 of the thermoacoustic refrigerator 2, feeds back to the thermoacoustic refrigerator 2 in the next elementary unit.

It can be seen from the above description, according to the present embodiment, the heat-actuated double-acting traveling-wave thermoacoustic refrigeration system heats the first non-normal-temperature heat exchanger 23 of the thermoacoustic engine 1 to produce acoustic power. Thermoacoustic energy conversion is induced inside the thermoacoustic engine 1 and the thermoacoustic refrigerator 2. Therefore, it is possible to produce refrigeration effect with heat input solely. In contrast to the prior art, the heat-actuated double-acting traveling-wave thermoacoustic refrigeration system according to the present invention can be applied in areas with abundant thermal energy and absence of electricity, thus being capable of a more extensive range of application.

In addition, because the thermoacoustic engine 1 has the first thermal buffer tube 14 and the first auxiliary heat exchanger 15, the gas medium entering into the expansion chamber 33 is close to room temperature by the cooling effect for the gas medium of the first thermal buffer tube 14 and the first auxiliary heat exchanger 15. Therefore, the piston 32 can work at room temperature, thus further lowering the processing difficulty of the piston 32 of the resonance device 3, reducing the manufacturing costs and improving the service life.

It is necessary to elaborate that, in an attempt to coordinate the phase relationship of the gas medium so as to fulfill the best working efficiency, as the numbers of the elementary units are all three, it is preferable to guarantee one working surface of the piston 32 is in the opposite direction of other working surfaces. Namely, for each resonance device 3, it must be guaranteed that the expansion chamber 33 is under an expanded condition as the compression chamber 34 is under a compressed condition. It is preferable to set the numbers of the elementary units as three or four.

Figure 3:
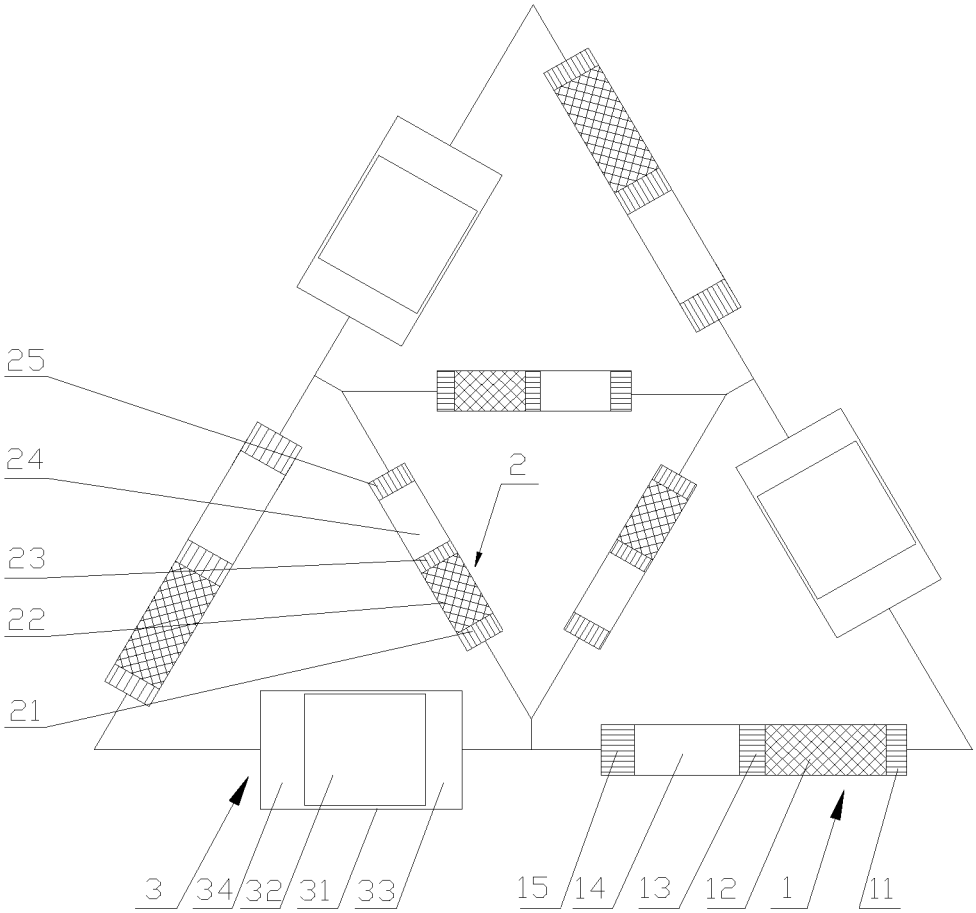
FIG. 3 is a schematic view of a heat-actuated double-acting traveling-wave thermoacoustic refrigeration system according to a second embodiment of the present invention.

Refer to FIG. 3, being a schematic view of a heat-actuated double-acting traveling-wave thermoacoustic refrigeration system according to a second embodiment of the present invention.

In the second embodiment, the structure of the heat-actuated double-acting traveling-wave thermoacoustic refrigeration system according to the present invention is substantially the same as the structure of the heat-actuated double-acting traveling-wave thermoacoustic refrigeration system according to the first embodiment. The differences are, in each elementary unit of the present embodiment, the first heat exchanger 15 of the thermoacoustic engine 1 connects to the expansion chamber 33 of the resonance device 3, the second main heat exchanger 21 of the thermoacoustic refrigerator 2 connects to the first main heat exchanger 21 of the thermoacoustic engine 1 in the same elementary unit, and the second auxiliary heat exchanger 25 of the thermoacoustic refrigerator 2 connects to the second main heat exchanger 21 of the thermoacoustic refrigerator 2 in another elementary unit. It can be seen that the thermoacoustic engine 1 and the resonance device 3 form an outer loop, the thermoacoustic refrigerator 2 forms an inner loop, thereby a dual-loop structure of acoustic power transmission is formed. In contrast to the first embodiment, the acoustic power of the heat-actuated double-acting traveling-wave thermoacoustic refrigeration system entering into the resonance device 3 according to the present embodiment has been reduced, which can reduce the swept volume of the piston 32 and increase the service life of the piston 32.

Similarly, in the present embodiment, the numbers of the elementary units are preferably three or four. It is necessary to elaborate that, as the numbers of the elementary units are four, the direction of the working surfaces of the piston 32 can either be the same or the opposite, that is, as the compression chamber 34 in the resonance device 3 is being compressed, the expansion chamber 33 can be simultaneously compressed or expanded.

The reason is that, if the compression chamber 34 is being compressed while the expansion chamber 33 is also being compressed, the phase difference of the volume flow at both ends of the thermoacoustic refrigerator 2 is 90 degrees. If the compression chamber 34 is being compressed while the expansion chamber 33 is also being compressed, the phase difference of the volume flow at both ends of the thermoacoustic refrigerator 2 is also 90 degrees, i.e., no matter how to arrange the compression chamber 34 and the expansion chamber 33, the phase difference of the volume flow at both ends of the thermoacoustic refrigerator 2 is invariably 90 degrees, and the work performances of the heat-actuated double-acting traveling-wave thermoacoustic refrigeration system are the same.

Apparently, the heat-actuated double-acting traveling-wave thermoacoustic refrigeration system according to the embodiment likewise has the technical effect of the heat-actuated double-acting traveling-wave thermoacoustic refrigeration system according to the above first embodiment, therefore, no tautology is necessary herein.

Figure 4:
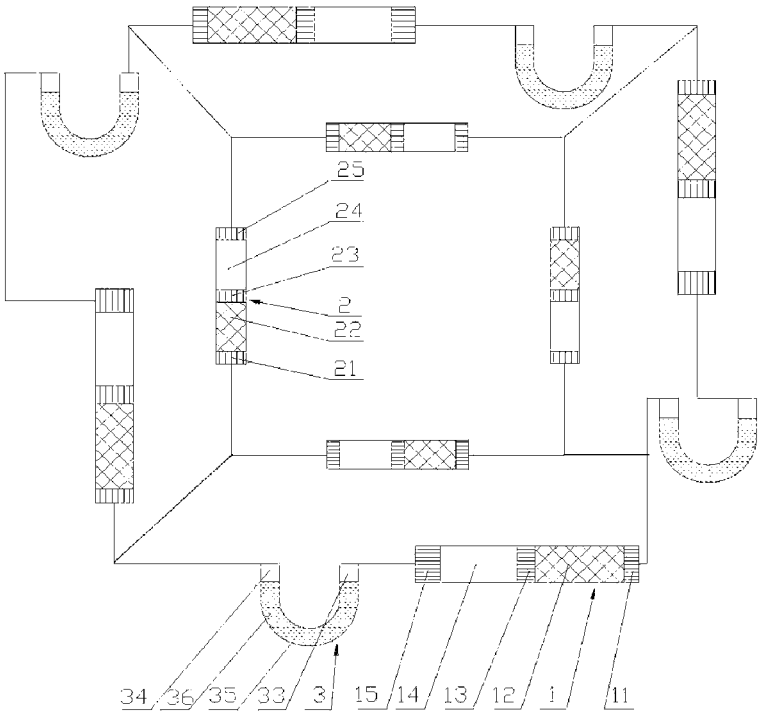
FIG. 4 is a schematic view of a heat-actuated double-acting traveling-wave thermoacoustic refrigeration system according to a third embodiment of the present invention.

Refer to FIG. 4, being a schematic view of a heat-actuated double-acting traveling-wave thermoacoustic refrigeration system according to a third embodiment of the present invention.

In the third embodiment, the structure of the heat-actuated double-acting traveling-wave thermoacoustic refrigeration system according to the present invention is substantially the same as the structure of the heat-actuated double-acting traveling-wave thermoacoustic refrigeration system according to the first embodiment. The differences are, in the present embodiment, the heat-actuated double-acting traveling-wave thermoacoustic refrigeration system has four elementary units, where the resonance device 3 includes a U-shaped tube 35, the U-shaped liquid column 36 inside thereof, and the expansion chamber 33 and the compression chamber 34 being at both ends of the U-shaped tube 35.

According to the embodiment, the resonance device 3 employs the U-shaped tube 35 and the U-shaped liquid column 36 forming the expansion chamber 33 and the compression chamber 34. The resonance device 3 can likewise be applied in structures with one expansion chamber 33 and one compression chamber 34 according to other embodiments of the present invention.

Figure 5:
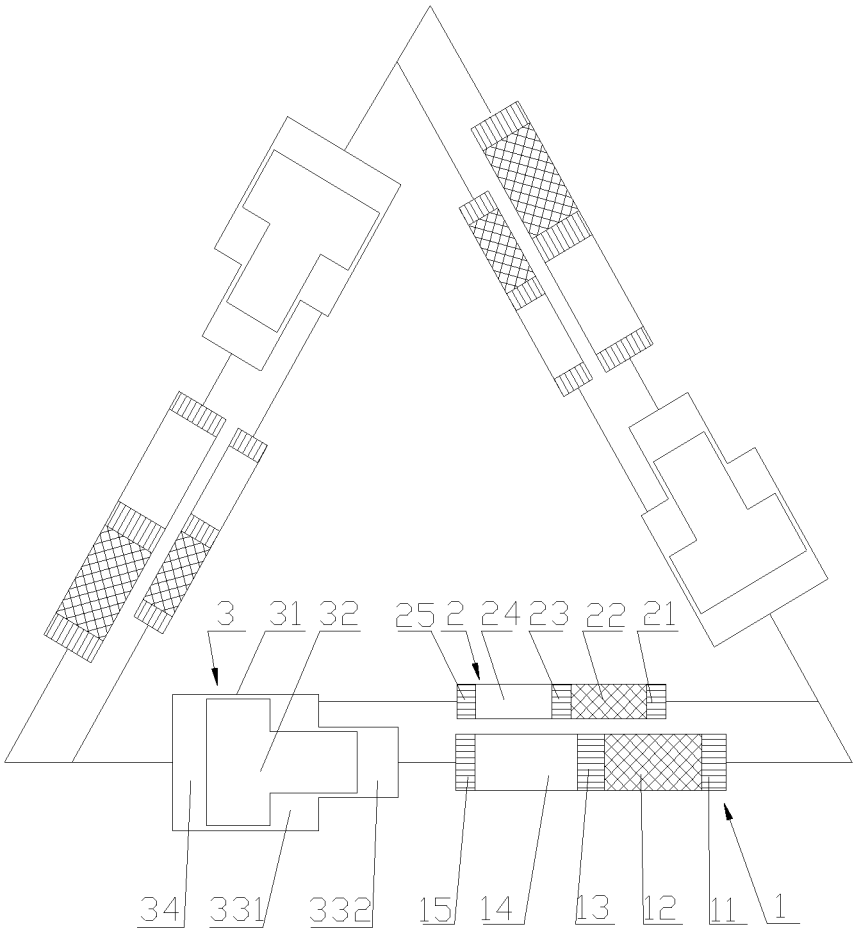
FIG. 5 is a schematic view of a heat-actuated double-acting traveling-wave thermoacoustic refrigeration system according to a fourth embodiment of the present invention.

Refer to FIG. 5, being a schematic view of a heat-actuated double-acting traveling-wave thermoacoustic refrigeration system according to a fourth embodiment of the present invention.

In the fourth embodiment, the structure of the heat-actuated double-acting traveling-wave thermoacoustic refrigeration system according to the present invention is substantially the same as the structure of the heat-actuated double-acting traveling-wave thermoacoustic refrigeration system according to the first and second embodiments. The differences are, the shapes of the cylinder 31 and the piston 22 of the resonance device 3 are of secondary staircase structures matching each other in terms of shapes. The chambers of the resonance device 3 include the compression chamber 34, the first expansion chamber 331 and the second expansion chamber 332.

The compression chamber 34 is a sealed chamber formed by the flat side of the piston 32 and the cylinder 31. The compression chamber 34 in one elementary unit connects to the first main heat exchanger 11 and the second main heat exchanger 21 of the thermoacoustic engine 1 and the thermoacoustic refrigerator 2 in another elementary unit.

The first expansion chamber 331 is a sealed chamber formed at the first stair on the staircase side of the cylinder 31 and the piston 32. In each elementary unit, the first expansion chamber 331 connects to the second auxiliary heat exchanger 25 of the thermoacoustic refrigerator 2 in the same elementary unit, forming an inner-loop structure.

The second expansion chamber 332 is a sealed chamber formed at the second stair on the staircase side of the cylinder 31 and the piston 32. In each elementary unit, the second expansion chamber 332 connects to the first auxiliary heat exchanger 15 of the thermoacoustic engine 1 in the same elementary unit, forming an outer-loop structure.

Apparently, the heat-actuated double-acting traveling-wave thermoacoustic refrigeration system according to the embodiment likewise has the technical effect of the heat-actuated double-acting traveling-wave thermoacoustic refrigeration system according to the above first embodiment; therefore, no tautology is necessary herein.

Figure 6:
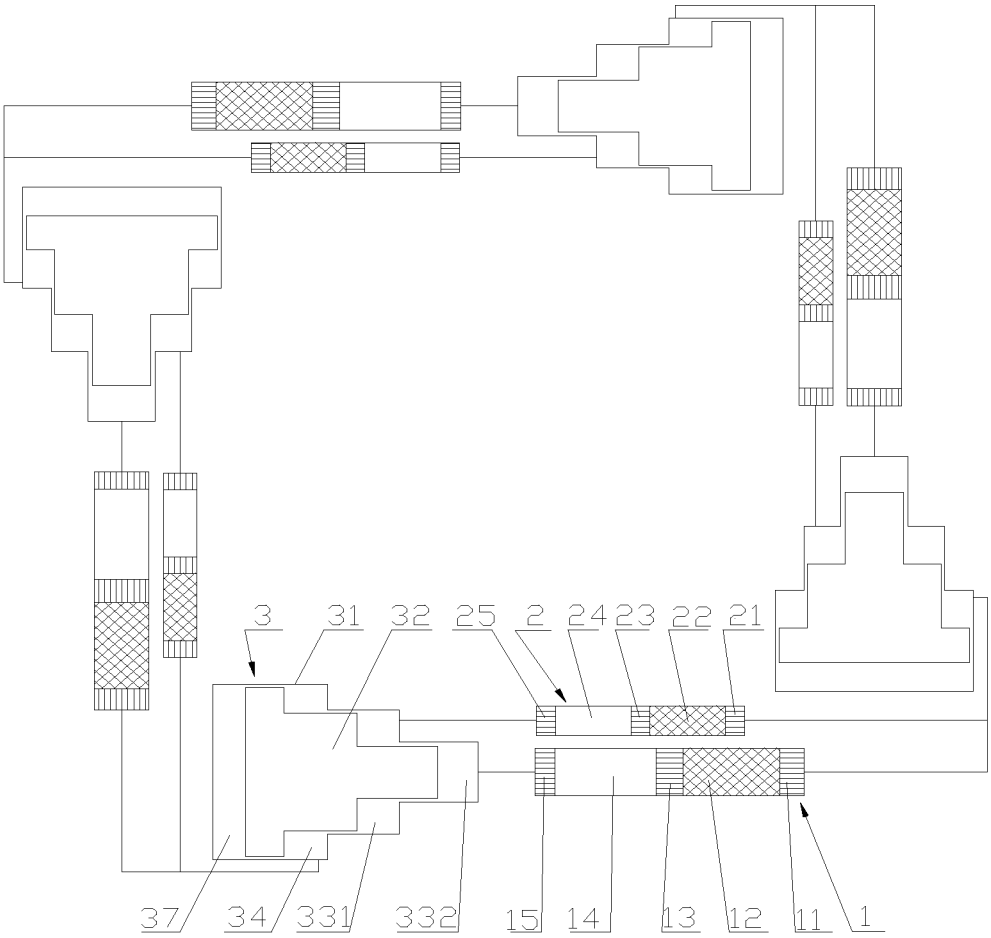
FIG. 6 is a schematic view of a heat-actuated double-acting traveling-wave thermoacoustic refrigeration system according to a fifth embodiment of the present invention.

Refer to FIG. 6, being a schematic view of a heat-actuated double-acting traveling-wave thermoacoustic refrigeration system according to a fifth embodiment of the present invention.

In the fifth embodiment, the structure of the heat-actuated double-acting traveling-wave thermoacoustic refrigeration system according to the present invention is substantially the same as the structure of the heat-actuated double-acting traveling-wave thermoacoustic refrigeration system according to the first and second embodiments. The differences are, the numbers of the elementary units are four; the shapes of the cylinder 31 and the piston 32 of the resonance device 3 are of tertiary staircase structures matching each other in terms of shapes. The chambers of the resonance device 3 include the compression chamber 34, the first expansion chamber 331, the second expansion chamber 332, and a cushion chamber 37.

The compression chamber 34 is a sealed chamber formed at the first stair on the staircase side of the cylinder 31 and the piston 32. The compression chamber 34 in one elementary unit connects to the first main heat exchanger 11 and the second main heat exchanger 21 of the thermoacoustic engine 1 and the thermoacoustic refrigerator 2 in another elementary unit.

The first expansion chamber 331 is a sealed chamber formed at the second stair on the staircase side of the cylinder 31 and the piston 32. In each elementary unit, the first expansion chamber 331 connects to the second auxiliary heat exchanger 25 of the thermoacoustic refrigerator 2 in the same elementary unit, forming an inner-loop structure.

The second expansion chamber 332 is a sealed chamber formed at the third stair on the staircase side of the cylinder 31 and the piston 32. In each elementary unit, the second expansion chamber 332 connects to the first auxiliary heat exchanger 15 of the thermoacoustic engine 1 in the same elementary unit, forming an outer-loop structure.

The cushion chamber 37 is a sealed chamber formed by the flat side of the piston 32 and the cylinder 31. The cushion chamber 37 functions as a gas spring capable of adjusting the working frequency of the heat-actuated double-acting traveling-wave thermoacoustic refrigeration system, thus making better work performance thereof possible.

Apparently, the heat-actuated double-acting traveling-wave thermoacoustic refrigeration system according to the embodiment likewise has the technical effect of the heat-actuated double-acting traveling-wave thermoacoustic refrigeration system according to the above first embodiment, therefore, no tautology is necessary herein.

Figure 7:
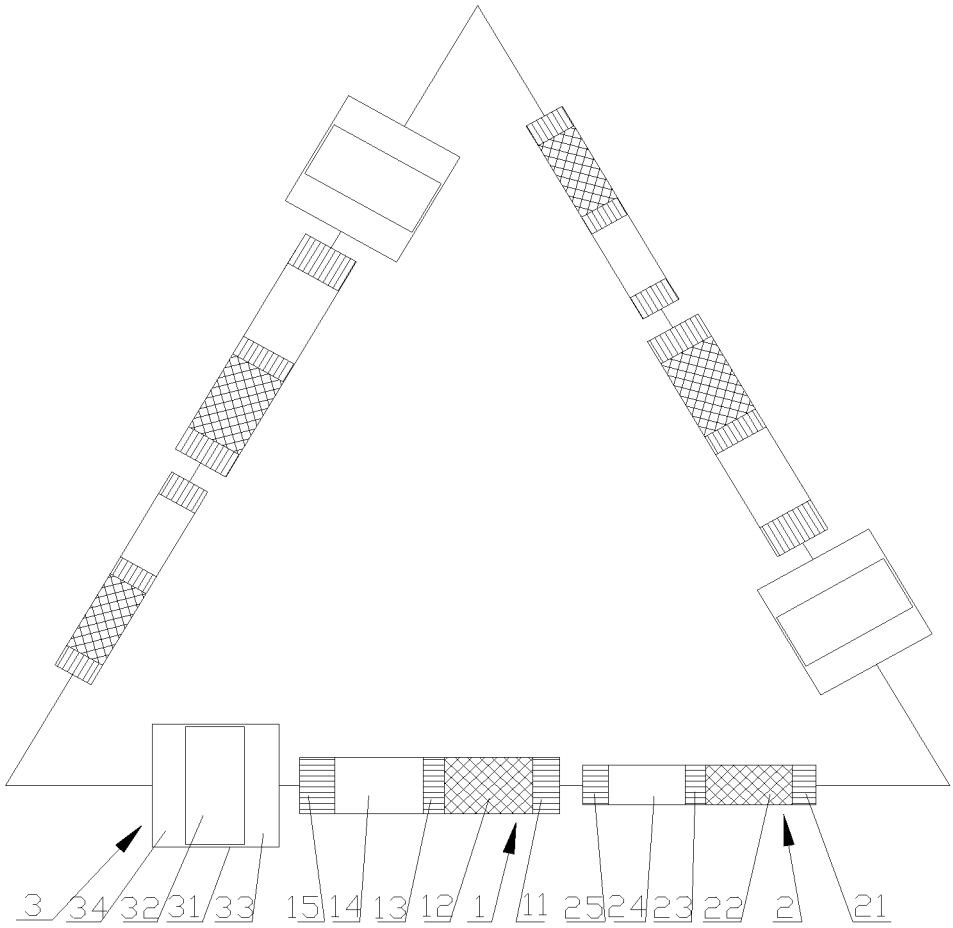
FIG. 7 is a schematic view of a heat-actuated double-acting traveling-wave thermoacoustic refrigeration system according to a sixth embodiment of the present invention.

Refer to FIG. 7, being a schematic view of a heat-actuated double-acting traveling-wave thermoacoustic refrigeration system according to a sixth embodiment of the present invention.

According to the sixth embodiment, the structure of the heat-actuated double-acting traveling-wave thermoacoustic refrigeration system according to the present invention is substantially the same as the structure of the heat-actuated double-acting traveling-wave thermoacoustic refrigeration system according to the first embodiment. The differences are, in each elementary unit, the first auxiliary heat exchanger 15 of the thermoacoustic engine 1 connects to the expansion chamber 33 of the resonance device 3, the first main heat exchanger 11 of the thermoacoustic engine 1 connects to the second auxiliary heat exchanger 25 of the thermoacoustic refrigerator 2 in the same elementary unit, and the second main heat exchanger 21 of the thermoacoustic refrigerator 2 connects to the compression chamber 34 of the resonance device 3 of another elementary unit, thereby a single-loop structure of acoustic power transmission is formed.

Figure 8:
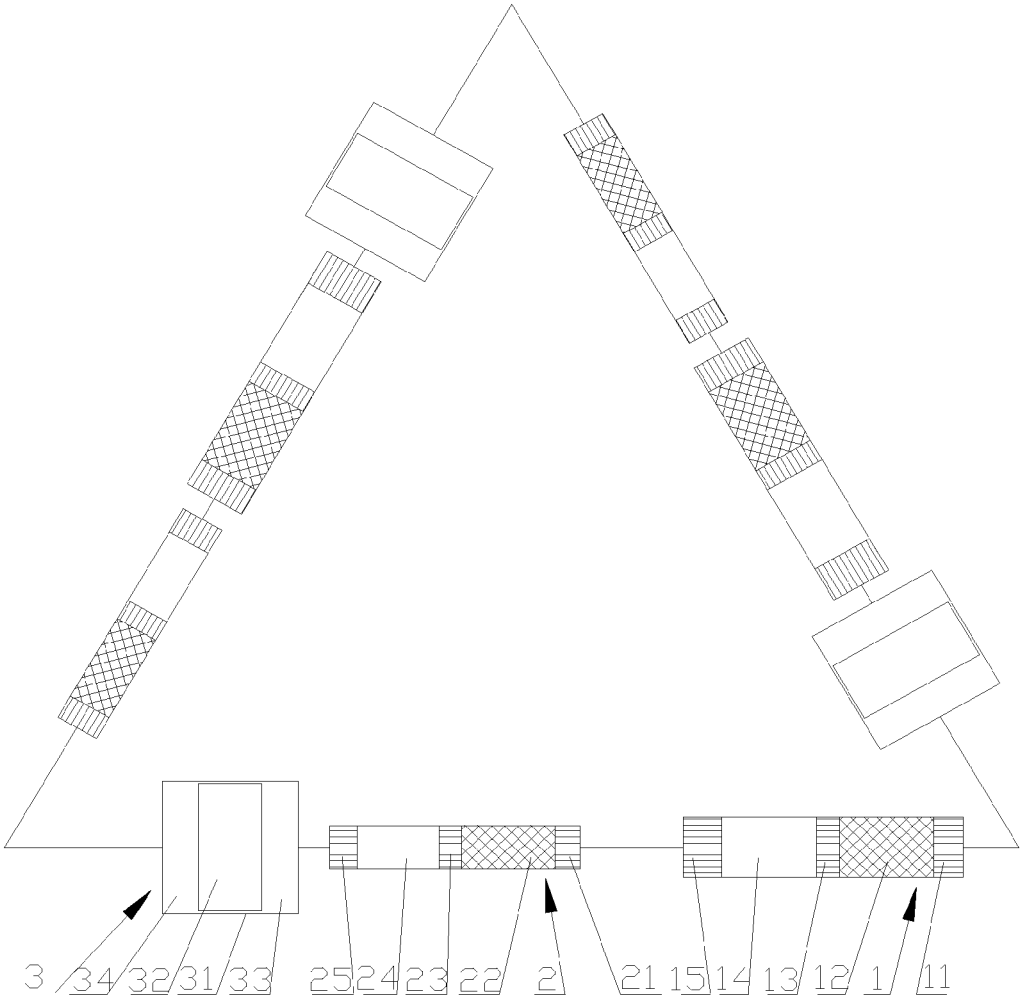
FIG. 8 is a schematic view of a heat-actuated double-acting traveling-wave thermoacoustic refrigeration system according to a seventh embodiment of the present invention.

Refer to FIG. 8, being a schematic view of a heat-actuated double-acting traveling-wave thermoacoustic refrigeration system according to a seventh embodiment of the present invention.

According to the seventh embodiment, the structure of the heat-actuated double-acting traveling-wave thermoacoustic refrigeration system according to the present invention is substantially the same as the structure of the heat-actuated double-acting traveling-wave thermoacoustic refrigeration system according to the first embodiment. The differences are, in each elementary unit, the second auxiliary heat exchanger 25 of the thermoacoustic refrigerator 2 connects to the expansion chamber 33 of the resonance device 3, the second main heat exchanger 21 of the thermoacoustic refrigerator 2 connects to the first auxiliary heat exchanger 15 of the thermoacoustic engine 1 in the same elementary unit, and the first main heat exchanger 11 of the thermoacoustic engine 1 connects to the compression chamber 34 of the resonance device 3 of another elementary unit, thereby a single-loop structure of acoustic power transmission is formed.

Figure 9:
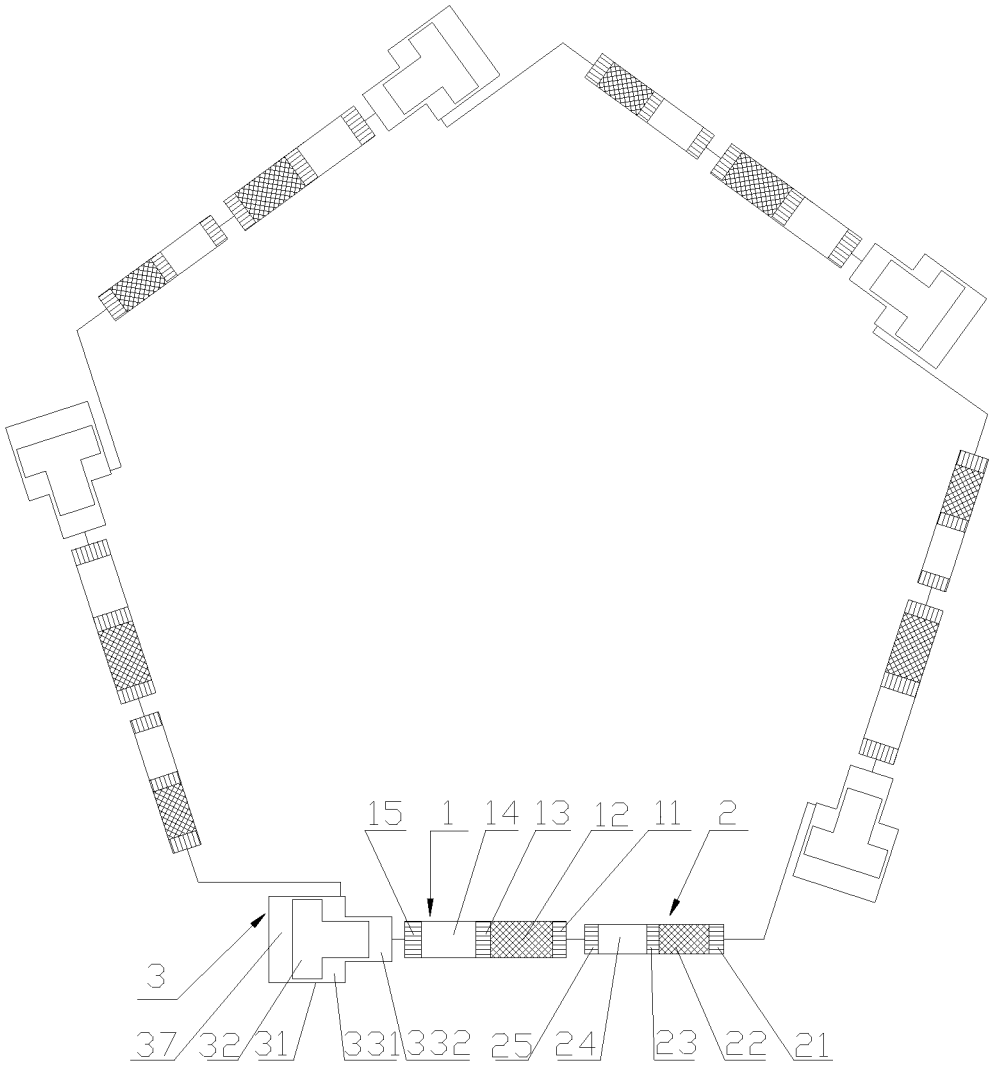
FIG. 9 is a schematic view of a heat-actuated double-acting traveling-wave thermoacoustic refrigeration system according to an eighth embodiment of the present invention.

Refer to FIG. 9, being a schematic view of a heat-actuated double-acting traveling-wave thermoacoustic refrigeration system according to an eighth embodiment of the present invention.

In the eighth embodiment, the structure of the heat-actuated double-acting traveling-wave thermoacoustic refrigeration system according to the present invention is substantially the same as the structure of the heat-actuated double-acting traveling-wave thermoacoustic refrigeration system according to the first embodiment. The differences are, the numbers of the elementary units are five; the shapes of the cylinder 31 and the piston 32 of the resonance device 3 are of secondary staircase structures matching each other in terms of shapes. The chambers of the resonance device 3 include the compression chamber 34, the expansion chamber 33, and the cushion chamber 37.

The compression chamber 34 is a sealed chamber formed at the first stair on the staircase side of the cylinder 31 and the piston 32. The expansion chamber 33 is a sealed chamber formed at the second stair on the staircase side of the cylinder 31 and the piston 32.

The cushion chamber 37 is a sealed chamber formed by the flat side of the piston 32 and the cylinder 31. The cushion chamber 37 functions as a gas spring capable of adjusting the working frequency of the heat-actuated double-acting traveling-wave thermoacoustic refrigeration system, thus making better work performance thereof possible.

In each elementary unit according to the embodiment, the first auxiliary heat exchanger 15 of the thermoacoustic engine 1 connects to the expansion chamber 33 of the resonance device 3, the first main heat exchanger 11 of the thermoacoustic engine 1 connects to the second auxiliary heat exchanger 25 of the thermoacoustic refrigerator 2 in the same elementary unit, and the second main heat exchanger 21 of the thermoacoustic refrigerator 2 connects to the compression chamber 34 of the resonance device 3 of another elementary uni, thereby a single-loop structure of acoustic power transmission is formed.

It is necessary to explain that, when the numbers of the elementary units are five or are greater than five, preferably the directions of the working surfaces of the piston 32 are the same, that is, the compression chamber 34 and the expansion chamber 33 must simultaneously be compressed or expanded. If one is being compressed meanwhile another one is being expanded, the conversion efficiency of the acoustic power of the thermoacoustic refrigerator 1 and the thermoacoustic engine 2 will be lowered.

What need to be explained finally is: the above embodiments is solely adopted to describe the technical solutions of the present invention, instead of limitation; even though elaboration has been made to the present invention in view of the aforementioned embodiments, a person skilled in the art shall understand: he or she can invariably amend the technical solutions disclosed by the aforementioned embodiments, or can equivalently replace some of the technical features thereof; nevertheless, the amendments or replacements shall not deviate the essence of the corresponding technical solutions from the spirit and scope of the technical solutions according to each embodiment of the present invention.

What is claimed is:

1. A heat-actuated double-acting traveling-wave thermoacoustic refrigeration system, comprising: at least three elementary units, wherein each elementary unit comprises a thermoacoustic engine, a thermoacoustic refrigerator, and a resonance device;

the thermoacoustic engine and the thermoacoustic refrigerator respectively comprising a main heat exchanger, a heat regenerator, a non-normal-temperature heat exchanger, a thermal buffer tube, and an auxiliary heat exchanger connected in sequence;

the resonance device comprising a sealed housing in which it is equipped with a moving part being in a reciprocating motion, wherein the moving part separates the housing into at least two chambers; and the main heat exchanger and auxiliary heat exchanger of each thermoacoustic engine and thermoacoustic refrigerator respectively connected to chambers of different housings, forming a dual-loop structure of gas medium flow.

2. The heat-actuated double-acting traveling-wave thermoacoustic refrigeration system according to claim 1, wherein the housing and the moving part are a cylinder of a cylindrical structure and a piston of a cylinder structure, numbers of the chambers are two, and the chambers are formed at both sides of the piston.

3. The heat-actuated double-acting traveling-wave thermoacoustic refrigeration system according to claim 1, wherein the housing is with a structure of U-shaped tube, and the moving part is a U-shaped liquid column inside the housing; numbers of the chambers are two, which are formed at both ends of the U-shaped liquid column.

4. The heat-actuated double-acting traveling-wave thermoacoustic refrigeration system according to claim 1, wherein the housing and the moving part are specifically a cylinder and a piston with staircase structures matching each other in terms of shapes; the chambers are formed at each stair at the staircase side of the piston and at a flat side of the piston.

5. The heat-actuated double-acting traveling-wave thermoacoustic refrigeration system according to claim 4, wherein the staircase structure is either a secondary staircase structure or a tertiary staircase structure.

6. A heat-actuated double-acting traveling-wave thermoacoustic refrigeration system, comprising: at least three elementary units, wherein each elementary unit comprises a thermoacoustic engine, a thermoacoustic refrigerator, and a resonance device;

the thermoacoustic engine and the thermoacoustic refrigerator respectively comprising a main heat exchanger, a heat regenerator, a non-normal-temperature heat exchanger, a thermal buffer tube, and an auxiliary heat exchanger connected in sequence;

the resonance device comprising a sealed housing in which it is equipped with a moving part being in a reciprocating motion, wherein the moving part separates the housing into at least two chambers; and in each elementary unit, the main heat exchanger or auxiliary heat exchanger of the thermoacoustic engine connects to the auxiliary heat exchanger or main heat exchanger of the thermoacoustic refrigerator; in each elementary unit, the other two ends of the thermoacoustic engine and the thermoacoustic refrigerator respectively connects to chambers of different housing, forming a single loop structure of gas medium flow.

7. The heat-actuated double-acting traveling-wave thermoacoustic refrigeration system according to claim 6, wherein the housing and the moving part are a cylinder of a cylindrical structure and a piston of a cylinder structure, numbers of the chambers are two, and the chambers are formed at both sides of the piston.

8. The heat-actuated double-acting traveling-wave thermoacoustic refrigeration system according to claim 6, wherein the shell is with a structure of U-shaped tube, and the moving part is a U-shaped liquid column inside the housing; numbers of the chambers are two, which are formed at both ends of the U-shaped liquid column.

9. The heat-actuated double-acting traveling-wave thermoacoustic refrigeration system according to claim 6, wherein the housing and the moving part are specifically a cylinder and a piston with staircase structures matching each other in terms of shapes; the chambers are formed at each stair on the staircase side of the piston and at a flat side of the piston.

10. The heat-actuated double-acting traveling-wave thermoacoustic refrigeration system according to claim 9, wherein the staircase structure is either a secondary staircase structure or a tertiary staircase structure.

* * * * *